US006846278B1

(12) United States Patent
Hill et al.

(10) Patent No.: US 6,846,278 B1
(45) Date of Patent: Jan. 25, 2005

(54) CARD PACKAGE PRODUCTION SYSTEM WITH MODULAR CARRIER FOLDING APPARATUS FOR MULTIPLE FORMS

(76) Inventors: Gregory S. Hill, 790 Waterford Ct., Lake Zurich, IL (US) 60047; Jeffery L. Hill, 1620 Castillian Way, Mundelein, IL (US) 60060; Robert J. Bretl, W6939 3.5 Rd., Menominee, MI (US) 49858

( * ) Notice: Subject to any disclaimer, the term of this patent is extended or adjusted under 35 U.S.C. 154(b) by 1261 days.

(21) Appl. No.: 08/584,084

(22) Filed: Jan. 11, 1996

Related U.S. Application Data

(62) Division of application No. 08/036,439, filed on Mar. 24, 1993, now Pat. No. 5,509,886.

(51) Int. Cl.[7] ..... B31F 7/00

(52) U.S. Cl. ..... 493/419; 493/421; 493/436; 493/437; 493/438

(58) Field of Search ..... 495/416, 417, 495/419–432, 436, 437, 438, 446, 405

(56) References Cited

U.S. PATENT DOCUMENTS

| | | | | | |
|---|---|---|---|---|---|
| 2,857,827 | A | * | 10/1958 | Labonbarde | 493/414 |
| 4,034,210 | A | * | 7/1977 | Hill | 235/61.12 |
| 4,194,685 | A | * | 3/1980 | Hill | 235/375 |
| 4,384,196 | A | * | 5/1983 | McCumber | 237/375 |
| 4,429,217 | A | * | 1/1984 | Hill | 235/380 |
| 4,432,745 | A | * | 2/1984 | Eldridge | 493/10 |
| 4,585,219 | A | * | 4/1986 | Lehmann | 270/46 |
| 4,944,131 | A | * | 7/1990 | Gough | 53/117 |
| 4,985,013 | A | * | 1/1991 | van der Werff | 493/444 |
| 5,129,876 | A | * | 7/1992 | Brabant | 493/471 |
| 5,183,246 | A | * | 2/1993 | Edwards | 270/45 |
| 5,352,177 | A | * | 10/1994 | Walter | 493/23 |

* cited by examiner

*Primary Examiner*—John Sipos
(74) *Attorney, Agent, or Firm*—James W. Potthast; Potthast & Associates

(57) ABSTRACT

A card package production system (20) for producing card packages (22) with cards (26) mounted to bifold carrier forms (24) with a pair of parallel, spaced, preweakened fold lines (33) and (34) dividing the body (32) of the carrier forms into leading end (35), middle (36) and lagging end (37) sections, a card carrier form folding apparatus (30) having a stop member (46) located extending downwardly into a blocking position along a folding path (44), a plurality of rollers (38)(39) and (40) for moving the carrier forms (24) along the folding path (44) and into the stop member (46) to buckle the leading end (35) and middle section (36) away from the folding path (44), a pushing member (56) driven by an electric motor (57) engaging the lagging end section (37) to push the carrier form (24) along the folding path (44) to pivotally swing the stop member (46) to a nonblocking position enabling the middle section (36) to fall back against the lagging section (37) folding the carrier (24) along fold lines (33) and (34) a transporting pushing pin member (74) interconnected with a circulating chain linkage (76) extending through a slot opening (242) in the folding path (44) to turn the folded carrier (24) about a pivot pin (220) for ejectment to a folded carrier outlet station (240).

26 Claims, 20 Drawing Sheets

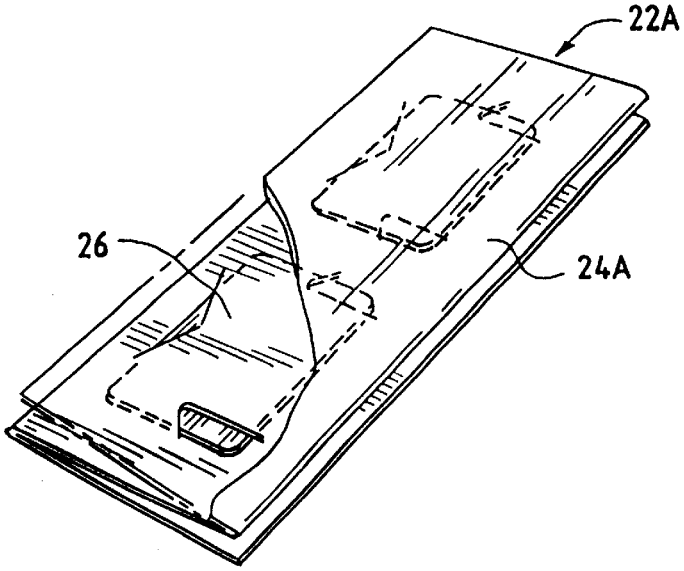
Fig. 2A
Fig. 2B
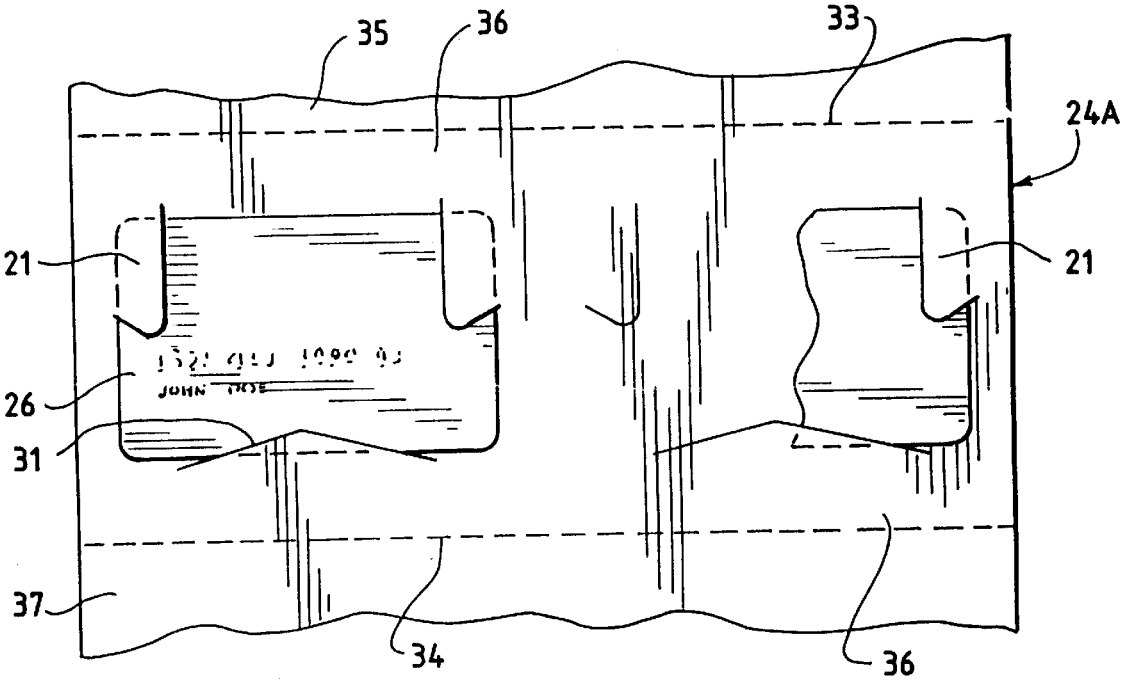

CARD PACKAGE PRODUCTION SYSTEM WITH MODULAR CARRIER FOLDING APPARATUS FOR MULTIPLE FORMS

CROSS-REFERENCES TO RELATED APPLICATIONS

This application divisional of application Ser. No. 08/036,439 filed Mar. 24, 1993 now U.S. Pat. No 5,509,886 is a entitled "Automatic Embossed Card Package Production Apparatus and Methods" of Hill et al. filed Feb. 19, 1993.

BACKGROUND OF THE INVENTION

Field of the Invention

This invention generally relates to a card package production system with a card carrier folding apparatus.

DESCRIPTION OF THE RELATED ART INCLUDING INFORMATION DISCLOSED UNDER 37 CFR 1.97–1.99

Card package production systems such as shown in U.S. Pat. No. 4,384,196 issued May 17, 1983 to McCumber et al. entitled "Apparatus and System for Preparing Data Cards and Mailer Forms and for Attaching Data Cards to Respectively Associated Mailer Forms"; No. B1 4,034,210 issued Jul. 5, 1977 to Hill et al. entitled "Credit Card Carriers and Methods of Manufacture"; U.S. Pat. No. 4,194,685 issued Mar. 25, 1980 to Hill et al. entitled "Verifying Insertion System Apparatus and Method of Operation" and U.S. Pat. No. 4,429,217 issued Jan. 31, 1984 to Hill et al. entitled "Verifying Insertion System and Apparatus".

In known systems different types of carrier forms are used in which the cards are wedge trapped between fold lines of a bifold carrier having leading end, middle and lagging end sections. However, neither of these systems fold carriers other than those which wedge trap one or two edges of a card by folding the end sections over the middle section when the cards are mounted. Moreover, in McCumber et al., because of the cards that form corner pockets for receipt of the card are diagonal oscillating fingers were required to open the pockets to enable receipt of the carriers therein.

Moreover, none of the known card package production systems were capable of folding different types of carriers in different ways but rather were limited to a single type of carrier and a single type of folding mechanism which precludes the use of different types of carriers.

SUMMARY OF THE INVENTION

It is therefore the principal object of the present invention to provide a card package production system with card carrier folding apparatus for multiple types of carriers which overcomes the disadvantages of folders in known systems and provides a simple and effective means for automatically folding unique carrier forms.

Moreover, the object of the present invention is achieved by providing a card package production system for producing card packages with cards mounted to a bifold carrier form with a body and a pair of parallel spaced preweakened fold lines dividing the body into leading end, middle and lagging end sections with a card carrier form folding apparatus, comprising means for supporting the body of the carrier form while moving in a first direction, means for defining a folding gap, means for guiding the leading end section to move in a second direction until the fold line between the leading end section and the middle section is aligned with the folding gap and means for moving the middle section and the leading end section adjacent the fold line through the folding gap to fold together the leading end section and the middle section along the fold line therebetween as they pass through the gap.

The object of the invention is further obtained by providing a card package production system for producing card packages with cards mounted to a bifold carrier form with a planar body having opposite sides and a pair of parallel, spaced, preweakened fold lines dividing the body into leading end, middle and lagging end sections with a card carrier form folding apparatus, comprising means for defining a folding path, means for folding the end section over one side of the middle section along the fold line therebetween, means in the folding path for blocking movement of the folded leading end section and middle section adjacent the fold line therebetween along the path and means for moving the lagging end section toward the blocking member to buckle the lagging end section and middle section of the folding path and fold the lagging end section toward folded engagement with another side of the middle section opposite the one side of the middle section along the fold line therebetween.

Still further, the object of the invention is acquired in part by provision of a card package production system for producing card packages with cards mounted to a bifold carrier form with a body and a pair of parallel, spaced, preweakened fold lines dividing the body into leading end, middle and lagging end sections with a card carrier form folding apparatus, comprising means for folding the form about said fold lines with the leading end section facing in one direction and means for flipping the folded carrier form to a position with the leading end section facing in another direction opposite to the one direction.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which:

FIG. 2A is a perspective view of a first type of carrier form employed in the card package production system of FIG. 1 with a portion broken away to view one of the cards mounted therein;

FIG. 2B is a front side view of the carrier of FIG. 2A with inserted, or mounted, cards prior to folding;

DESCRIPTION OF THE PREFERRED EMBODIMENT

Figure 1:
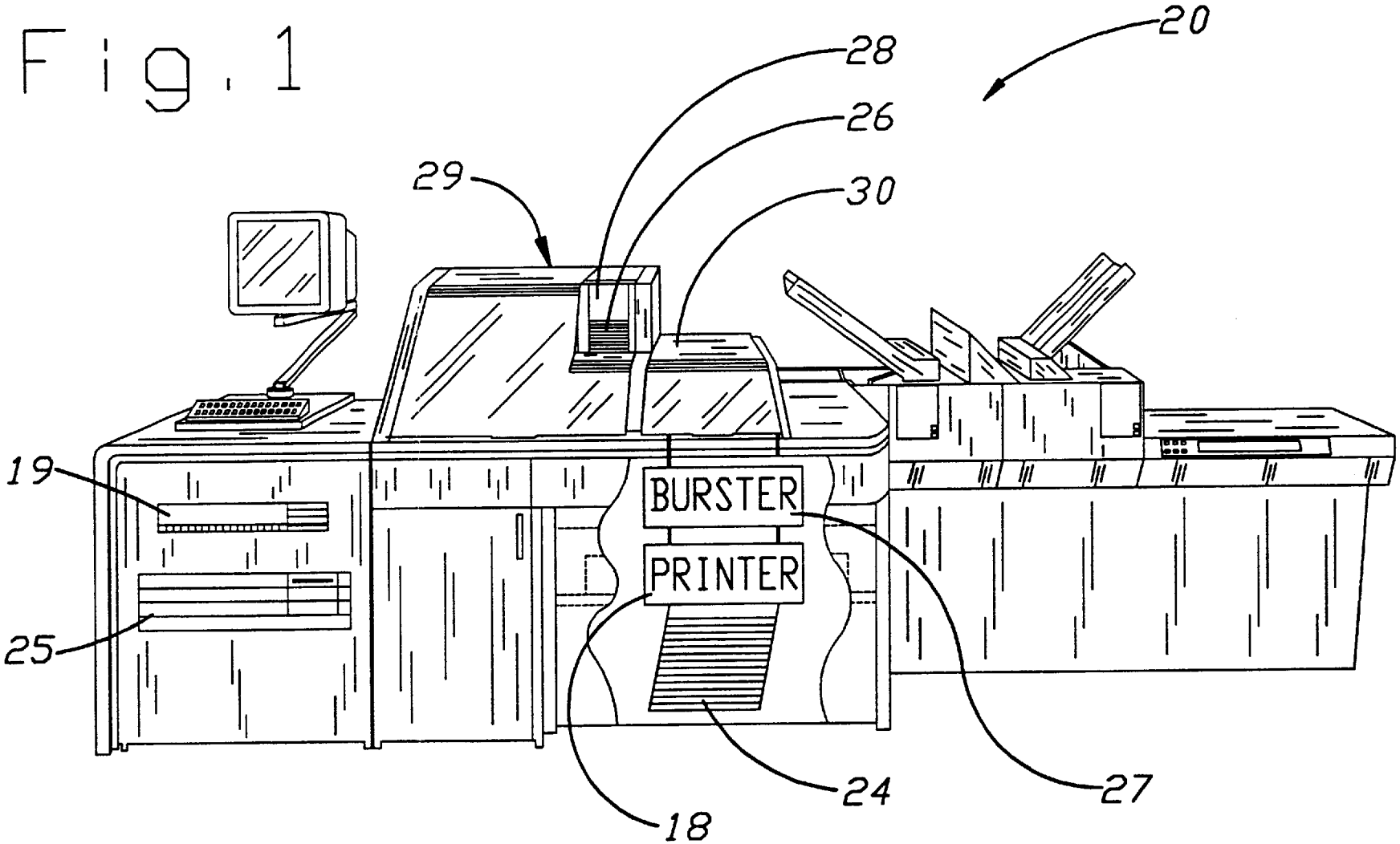
FIG. 1 is a perspective view of the preferred embodiment of the card package production system of the present invention.

Referring to FIGS. 1, 2A, 2B, 3A and 3B, the card package production system 20 has a microprocessor based computer 25 and an open reel tape drive 19 to control the insertion, rejection, folding and stuffing of cards 26 and carrier forms 24 to produce card packages. Within the card package production system 20, an interconnected fan of bifold carrier forms 24 are fed from a printer 18 to a bursting module 27 to separate the fan into individual carrier forms. The cards 26 are placed in a hopper 28 in the card package production system 20 and are transported to an embosser/encoder 29 for embossing characters and encoding a magnetic stripe on each card. The cards 26 are moved to an insertion station 23 for insertion into matching card carrier forms 24. Cards 26 which do not have information matching that of the corresponding carrier forms 24 are rejected. The cards 26 inserted into matching carrier forms 24 are transported to a card carrier form folding apparatus 30 to fold the bifold carrier forms prior to stuffing them into envelopes.

Figure 3A:
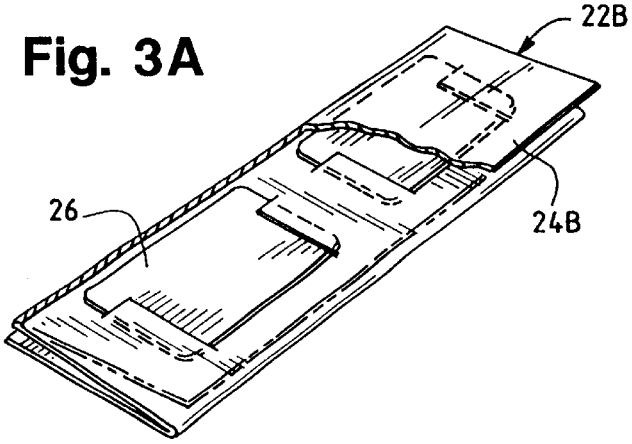
FIG. 3A is a perspective view of a second type of carrier form employed in the card package production system of FIG. 1 with a portion broken away to view one of the cards mounted therein.
Figure 3B:
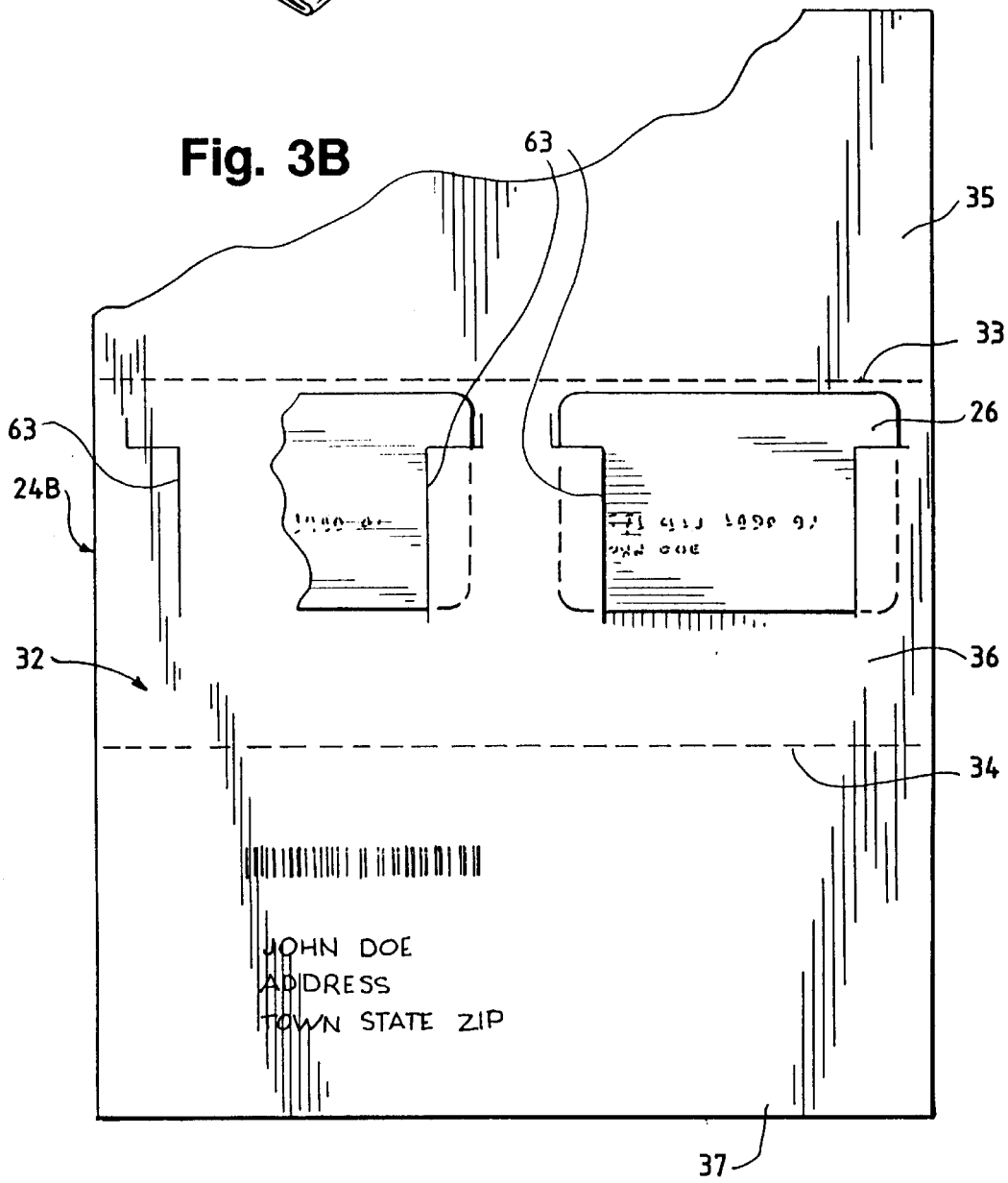
FIG. 3B is a front side view of the carrier of FIG. 3A with inserted, or mounted, cards prior to folding.

As seen in FIGS. 2A, 2B, 3A and 3B, the card package production apparatus produces card packages 22A and 22B from two different card carrier forms 24A and 24B. Carrier form 24A has a pair of corner pockets 21 to hold the card 26 against lateral sliding movement and a fold flap 31 to secure a bottom edge of the card 26. The folding of carrier form 24A of FIG. 2A is accomplished by the embodiment of the card carrier folding apparatus 30A described in FIGS. 4A through 4F. Carrier form 24B as seen in FIG. 3B has a pair of rectilinear-shaped insertion slots 63 for receipt of cards 26. The folding of carrier form 24B is performed by the card carrier for folding apparatus 30B embodiment shown in FIGS. 5A through 5H. As seen in FIGS. 2B and 3B the body 32 of each of the bifold carrier forms 24A and 24B have a pair of parallel, spaced, preweakened fold lines 33 and 34 dividing the body into a leading end 35, middle 36, and lagging end 37 sections. Fold line 33 divides the leading end 35 and middle end 36 while fold line 34 divides the middle 35 and lagging end section 37.

Figure 5A:
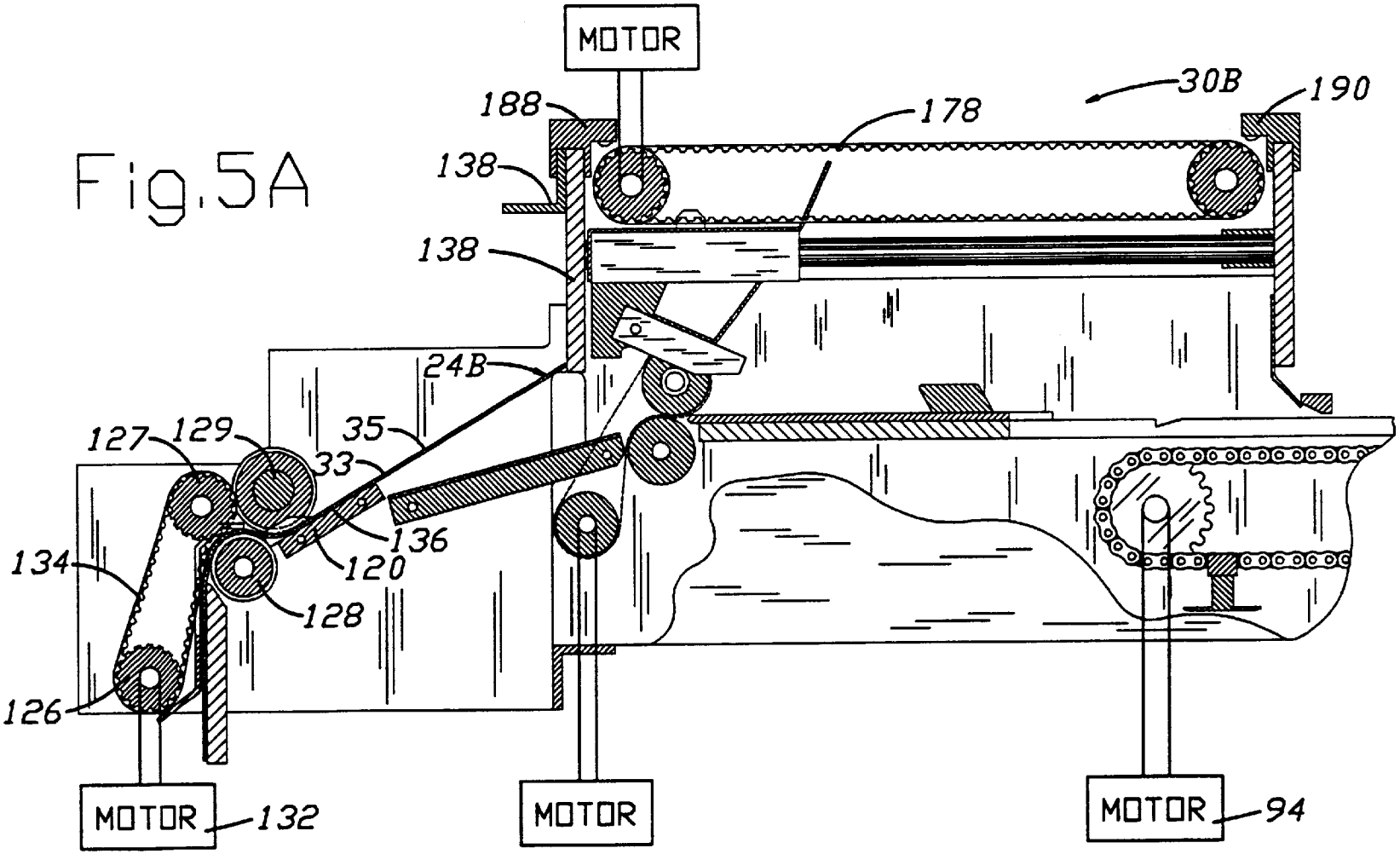
FIG. 5A is a side view of the preferred embodiment of the folding mechanism employed in the card package production system of FIG. 1 to fold the carrier forms of FIGS. 3A and 3B during an initial step in the folding sequence.

Referring to FIGS. 5A–5H, another embodiment of the card carrier form folding apparatus 30B of the present invention is shown to fold the carrier form 24B of FIGS. 3A and 3B with inserted card 26. In FIG. 5A, the card carrying form 24B is moved in a substantially horizontal direction from a carrier support member 120 until the carrier abuts with a vertically mounted stop guide 124. The carrier 24B is moved by gears 126 and 127 connected by belt 134 to turn roller 128. Electric motor 132 drives gear 126 which in turn moves gear 127 through drive belt 134. Belt 134 is mounted in movable relation with roller 128 to drive roller 128. The leading end 35 of carrier 24B is moved to the stop guide 124 by roller 128 through carrier support member 120. Idle roller 129 is used to open the flaps 63, FIG. 3B, of carrier 24B to aid in the insertion of cards 26. For further description of the insertion of card 26 into carrier form 24B of FIG. 3B, reference can be made to U.S. patent application Ser. No. 08/036,664 of Hill et al. entitled "Embossed Card Package System With Modular Inserters For Multiple Forms And Card Verification Apparatus" filed Mar. 24, 1993, contemporaneously filed herewith.

The carrier support member 120 has a support surface 136 for slidable support of the carrier form 24B being moved by roller 128 in the first direction toward stop guide 124. The carrier support member or middle guide 120 extends in a diagonal direction to direct and guide the leading end 35 of the carrier form 24B to the stop guide. The leading end 35 moves in a second, substantially vertical direction along the surface of the stop guide in response to the leading end section 35 coming into contact with the stop guide. Roller 128 continues to move the leading end section 35 vertically along the surface of the stop guide until the leading end abuts with stop member 138.

Figure 5B:
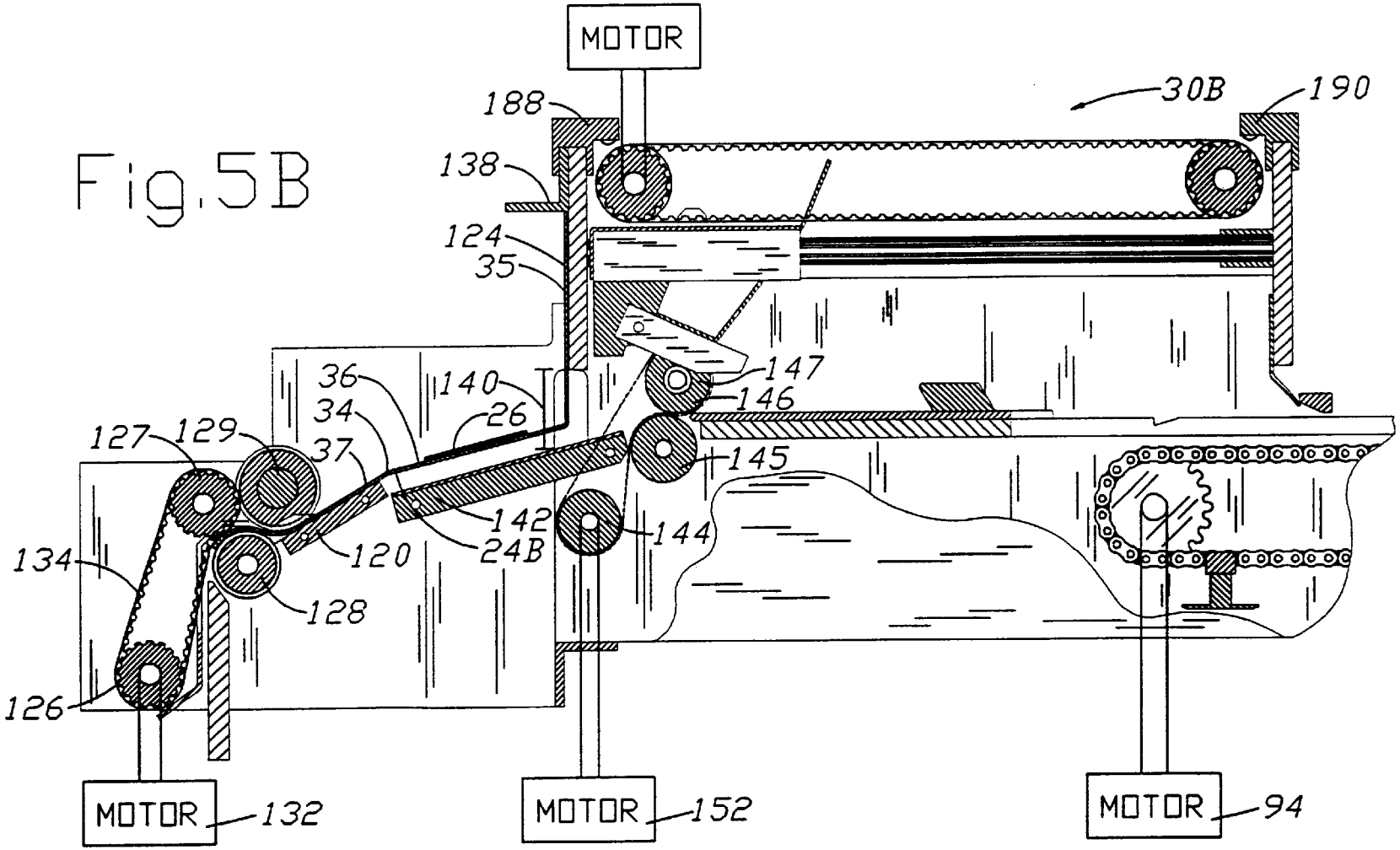
FIG. 5B is a side view of the folding mechanism of FIG. 5A during a later step in the folding sequence at which the leading edge of the carrier form has engaged a stop member and the lead fold line is aligned with a folding gap.

Referring to FIG. 5B, the stop guide 124 is shown to guide the carrier form 24B vertically to the stop member 138. The L-shaped stop member 138 is mounted to and extends transversely to the stop guide 124. A fold gap 140 exists between the stop guide 124 and a channel plate 142. The leading end section 35 of the carrier 24B is guided by guide plate 124 to move vertically until the fold line 33 between the leading section 35 and middle section 36 of carrier 24B is aligned with the folding gap 140. The stop member 138 stops the vertical movement of the leading section 35 when the fold line 33 is aligned with the folding gap 140. Roller 128 continues to push the carrier form 24B through the folding gap 140 along channel plate 142 and the rollers 145 and 146.

Figure 5C:
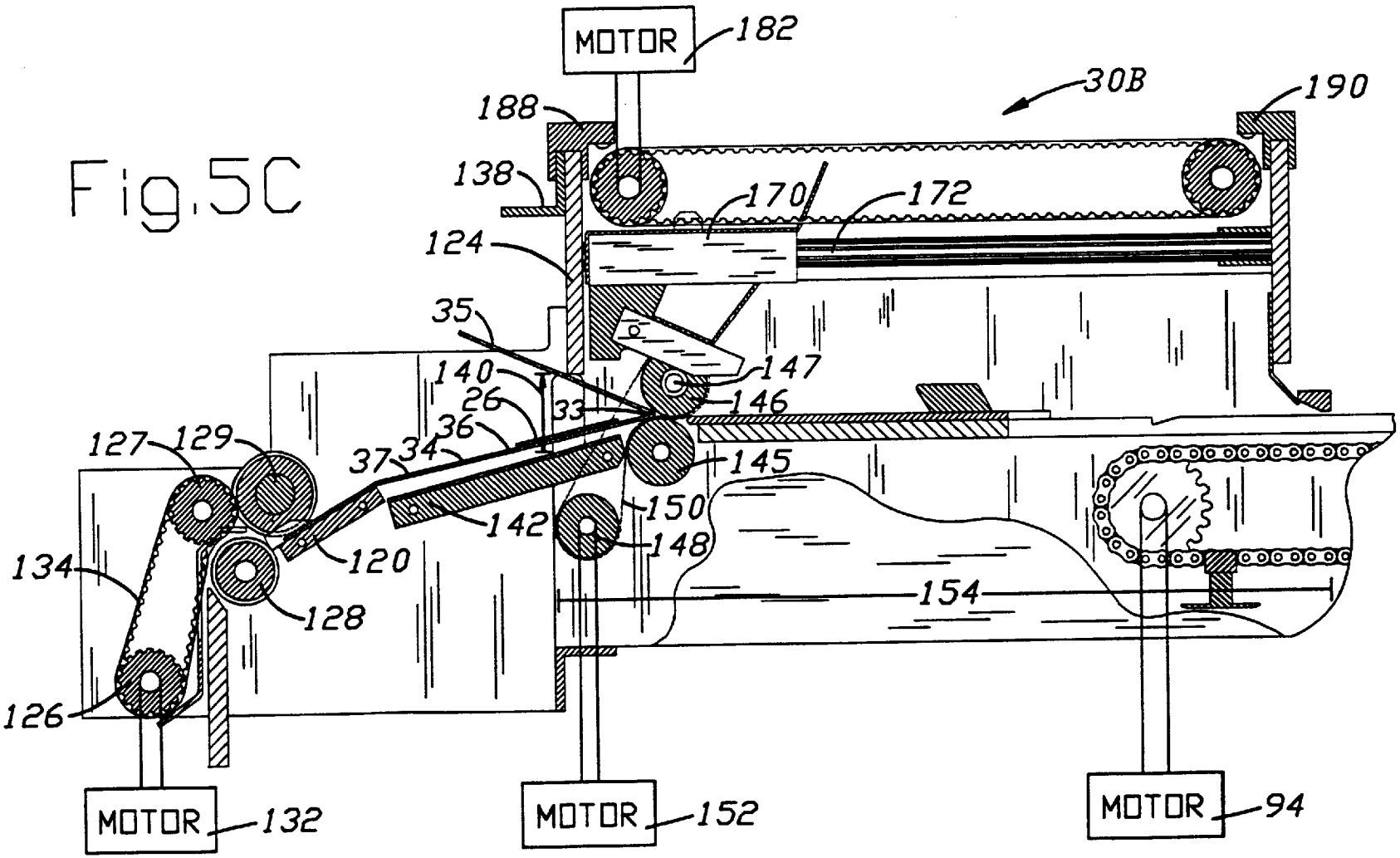
FIG. 5C is a side view of the folding mechanism of FIG. 5B during a still later step in the folding sequence in which the carrier form has been folded at the lead fold line and pushed through the folding gap for engagement between a pair of rollers.

Referring to FIG. 5C, the middle section 36 and the leading end section 35 adjacent fold line 33 are fed through fold gap 140. As the fold line 33 passes through fold gap 140 the leading section 35 moves downward away from the stop member 138 and begins to fold together with the middle section 35 along the fold line. The fold line 33 moves through rollers 145 and 146 to fold leading section 35 back against one side of the middle section 36. Electric motor 152 coupled with the microprocessor based computer 25, FIG. 1, powers roller 148, FIG. 5C, to drive rollers 145 and 146 interconnected through belt 150. Rollers 145 and 146 move the carrier 24B folded at fold line 33 along the folding path 154. A home position optical sensor 188 senses the sliding bar 170 mounted by elongate sliding bar extending substantially parallel along the length of the folding path 154 to signal the computer 25, FIG. 1, that the form folding apparatus 30B is in the passing position. The home position sensor 188 operates in the same manner as sensor 88 described above with reference to FIGS. 4A and 4B. The home position sensor 188 signals to the computer 25, FIG. 1, to feed carrier 24B through the folding path 154.

Figure 5D:
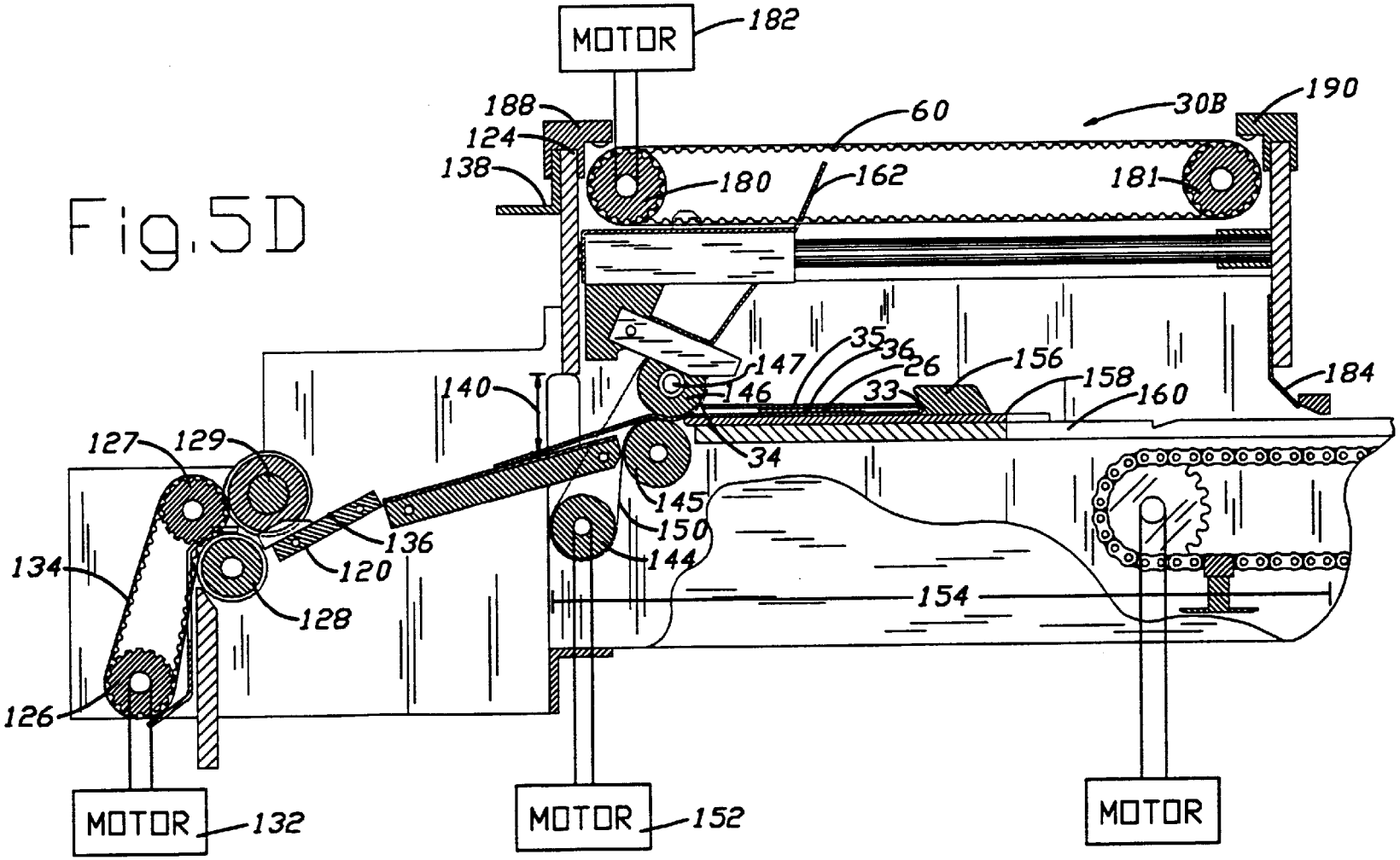
FIG. 5D is a side view of the folding mechanism of FIG. 5C in which the carrier engages at the folded edge between the leading end section and middle section have been pushed against a stop member.

Referring to FIG. 5D, the carrier form 24B folded along fold line 33 is moved along the folding path 154 on a side of the folding gap 140 opposite of the carrier support member 120. The fold along fold line 33 prevents the card 36 from falling out of the carrier 24B through the rectilinear slots 63, FIG. 3B. Rollers 145, FIG. 5, and 146 in rolling contact with the carrier form 24B move the lagging end section 37 through the gap 140 and along the folding path 154. A stopping member 156 mounted to the surface of a folding path support member 158 supported by base plate 160 blocks movement of the folded edge along fold line 33 of the carrier 24B. As the lagging section 37 is moved through the folding gap 140, the fold line 34 between the lagging section and the middle section 36 buckles upwards away from the folding path 154 in response to the blocking of the carrier 24B at fold line 33 against the stopping member.

Figure 5E:
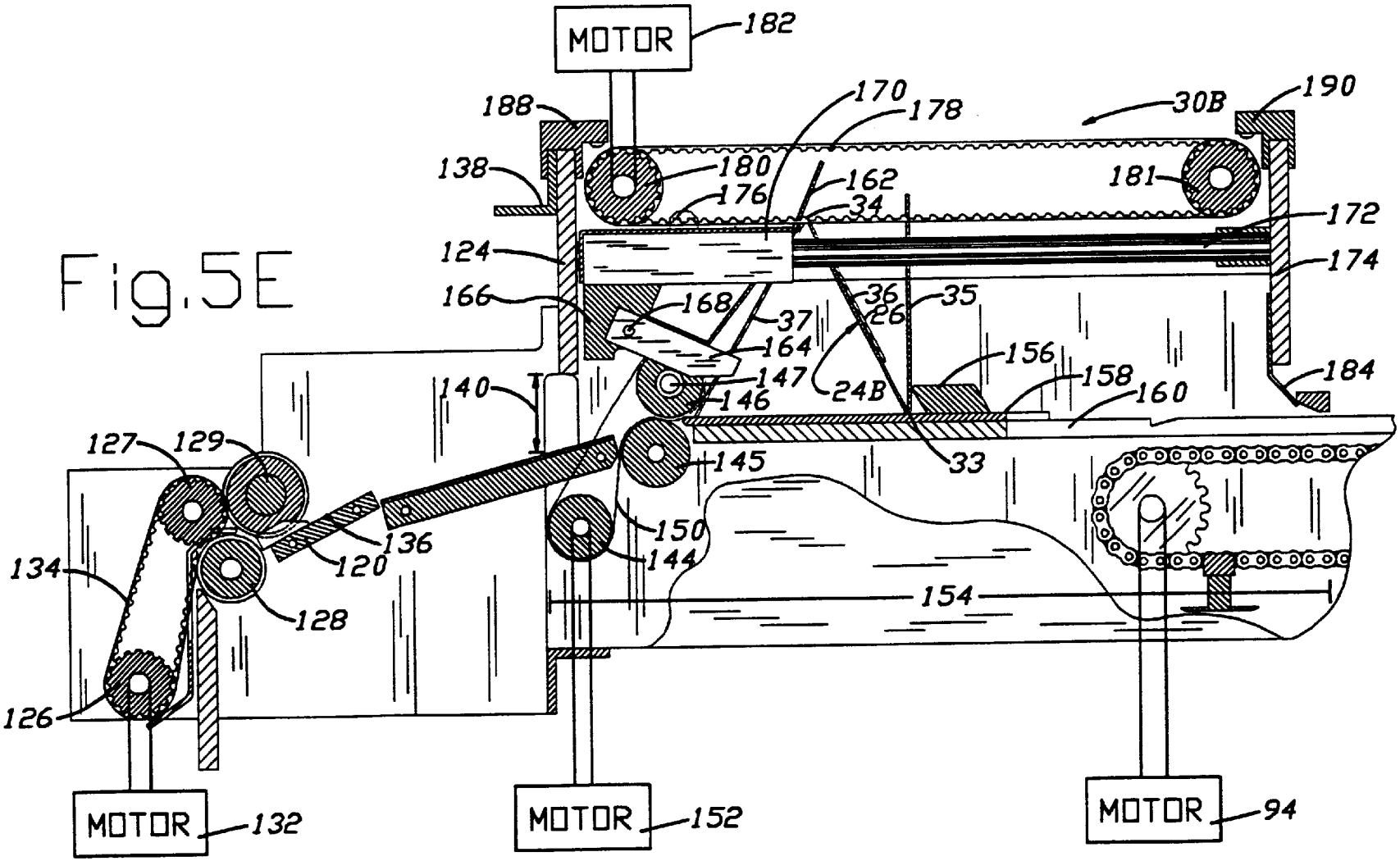
FIG. 5E is a side view of the folding mechanism of FIG. 5D during a later step in the folding sequence in which the pushing movement of the rollers on the lagging end section has pushed the carrier form pivotally away from the folding path along the lagging fold line.

Referring to FIG. 5E, the blocking member 156 forces the fold line 34 between the middle section 36 and lagging section 37 to move up as the lagging section is moved towards the stopping member. The lagging section 37 of carrier 24B partially abuts the pushing member 162. The folded carrier form 24A pivots about the folded edge 33 between the leading section 35 and middle section 36 while the form is being pushed into the stopping member 156. The pushing member 162 is attached to a pivoting member 164 which is pivotally mounted on the axle 147 of rollers 146 for lateral movement relative to the folding path 154. The pivoting member 164 is pivotally connected to plate 166 by pin 168. The plate is interconnected with sliding member 170 which is slidably mounted to elongate sliding bar 172 extending between the stop guide 124 and the folding apparatus housing 174. Hinge 176 attaches the sliding member to belt 178 which is driven between gears 180 and 181 by motor 182. Motor 182 is actuated to drive the belt 178 in response to a signal received from the microprocessor based computer 25, FIG. 1, coupled with motor 182. Motor 182 is activated to move pushing member 162 after a predetermined time from an optical sensing of the carrier by a sensor located at the bursting station 27. The activation of motor 182 is the same as the manner discussed above for operating motor 57 with reference to FIG. 4C.

The motor 182 drives belt 178 to move sliding member 170 across the folding path 154 along sliding bar 172. The pivoting member 164 connected with pushing member 162 pivots down about pin 168 as the pivoting member rolls off axle 147. The pushing member 162 begins to push against the upwardly bucked body of the end section 37 as it laterally moves down toward the folding path 154. The sliding member 170 supported by the elongate sliding bar 172 mounts the pushing member 162 for translational movement along the folding path 154 to push the carrier form 24B along the folding path.

Figure 5F:
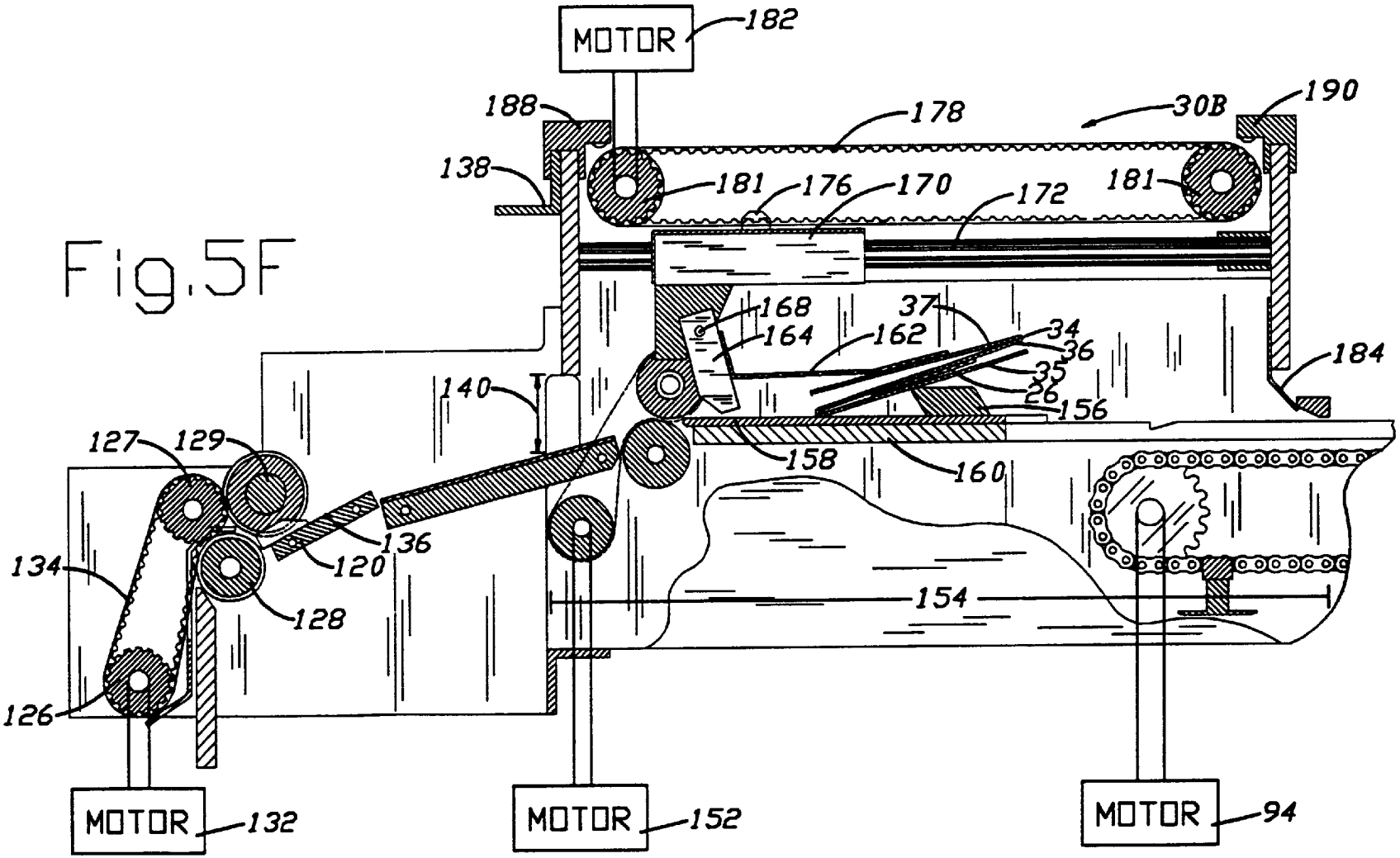
FIG. 5F is a side view of the folding mechanism of FIG. 5E during a later step in the folding sequence in which a pushing arm has pivoted downwardly and moved in the direction of carrier movement to flip the carrier form over the stop member.

Referring to FIG. 5F, belt 178 translationally moves the pushing member 162 across the folding path 154. The pivot member 164 rolls off the axle 147 of roller 146 to enable the pushing member to fold the lagging end section 37 toward folded engagement with the side of the middle section 36 opposite that of the folded side with the leading section 35. The pushing member 162 pushes the body of the lagging section 37 at a location spaced from the edge of the lagging section. As the pushing member 162 is moved along the folding path 154 the pushing member slips the lagging end section 37 over the stopping member 156 and onto the middle section 36. As seen in FIGS. 5B–5D, the pushing member 152 is moved to a passing section in which the carrier form 24B is enabled to pass by the pushing member 146 along the folding path 154. In FIG. 5F, the pivot member 164 connected with the pushing member 162 is moved off axle 147 laterally relative to the folding path 154 to the pushing position in which the pushing member is engageable with the carrier form 24B on the path. In response to a signal from the computer 25, FIG. 1, after a predetermined time from the sensing the carrier 24B at a location in the burster 27, the drive motor 182 is actuated to laterally move the pushing member 162 relative to the folding path 154. The pushing member 162 moves an edge of the lagging end section 37 toward the stopping member 156 to fold the lagging section against the middle section 36. As the sliding member 170 continues to move across the elongate sliding bar 172, the pushing member 162 slides along the surface of the lagging section 37 until the pivot member 164 abuts with the carrier form 24A. The pivot member 164 moving translationally along the folding path 154 pushes the lagging section 37 and middle section 36 over the stopping member 156 onto the leading end section 35. The folded carrier form 24B is flipped over the stopping member 156 in such a manner that the leading end section 35 faces in an opposite direction to the direction faced prior to being flipped.

Figure 5G:
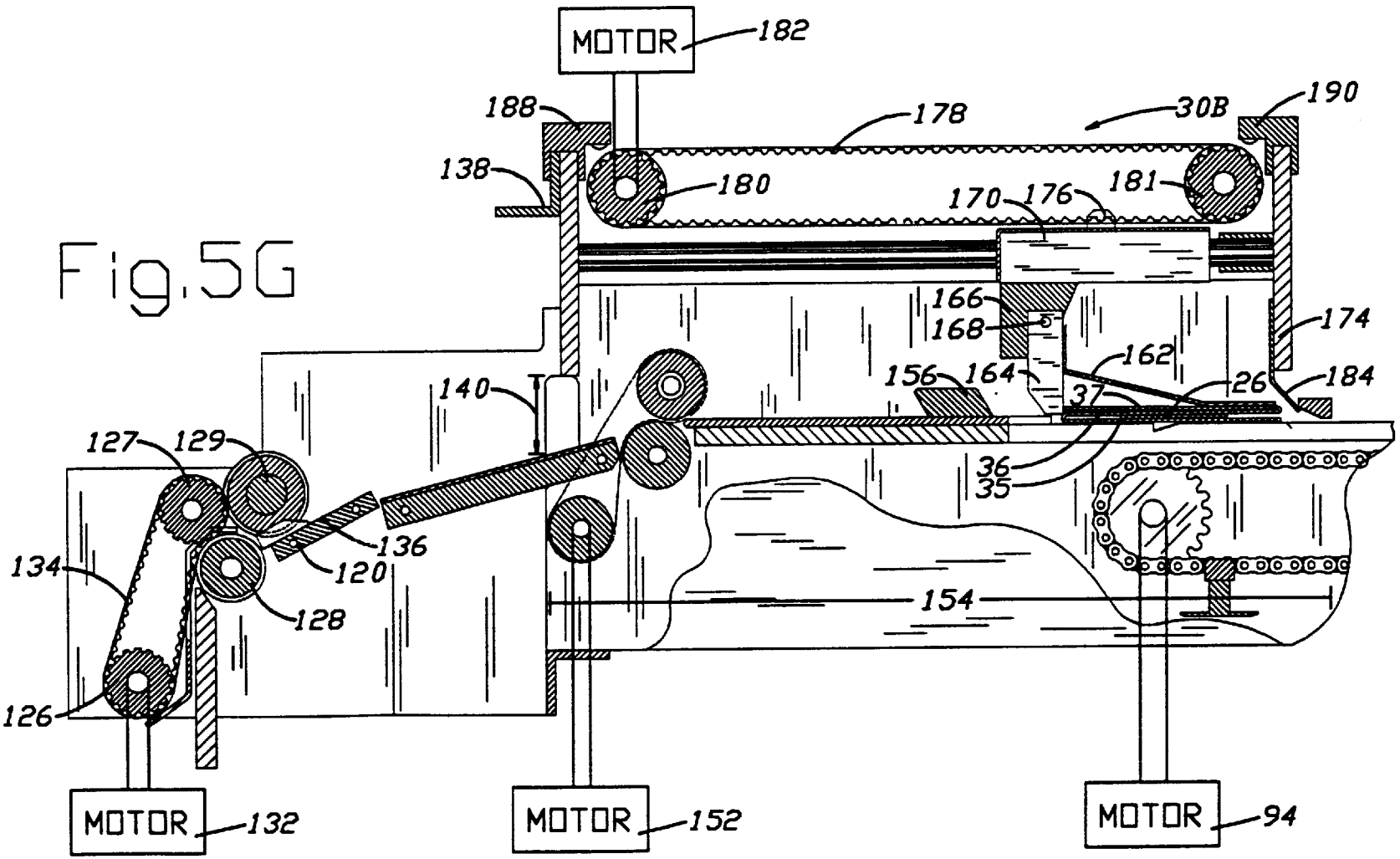
FIG. 5G is a side view of the folding mechanism of FIG. 5F during a later step in the folding sequence in which the pushing arm is engaged with the edge of the folded carrier form and pushed it over the stopping member.

Referring to FIG. 5G, the card carrier form folding apparatus 30B is shown in the pushing position in which the pushing member 162 and the connected pivot member 164 are engaged with the carrier 24B on the folding path 154.

The pivoting member 164 slidably engages an edge of the lagging section 37 to push the carrier 24B along the surface of the folding path. The pushing member 162 pushes down on the lagging end section 37 to fold the lagging section along fold line 34 against middle section 35. The folded and flipped carrier form 24B is pushed by the pushing member 152 and the pivoting member 164 through an angled folding fixture 184 connected with the folding apparatus housing 174. The folding fixture 184 is angled to act as a guide to ensure a complete fold of the carrier form 24B.

Figure 5H:
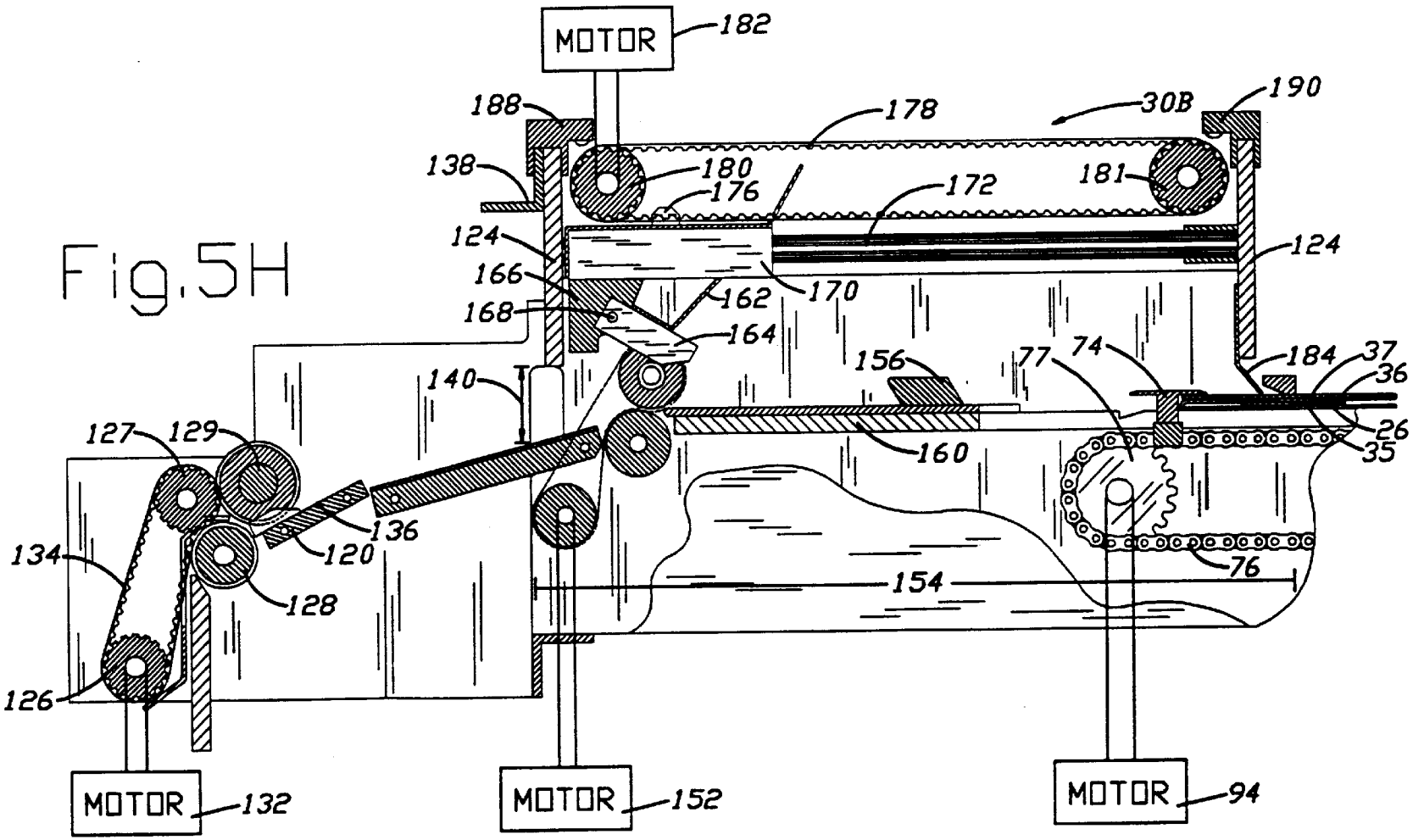
FIG. 5H is a side view of the folding member of FIG. 5G during a later step in the folding sequence in which the folded carrier form has been partially pulled through a folding gap for engagement by another pusher of the carrier turning apparatus and the pushing member has been returned to the home position.

Referring to FIG. 5H, the card carrier form folding apparatus 30B is returned to the passing position in which the pivoting member 164 slidably rests on the axle 147 of roller 146 and the pushing member 162 is spaced from the carrier forms 24B enabling them to pass along the folding path 154 to a position to be pushed. The motor 182 is actuated to stop and return to the pushing member 162 to the passing position by the fold complete sensor 190 sensing the sliding member when in the folded position as seen in FIG. 5G. The fold complete sensor 190 coupled with the computer 25, FIG. 1, senses the sliding member 170 when the carrier has been folded and triggers the motor 182 to drive the belt 178 to return to the home or passing position. In response to the pushing member 162 being returned to the passing position, a transportation pin member 74 connected with chain linkage 76 is moved through a slot opening 242, FIG. 6A, of the base plate 160. A motor 94 connected with gear 77 drives the chain linkage 192 to move the transport pin to the folding path 154 upon the fold complete optical sensor 190 sensing a change in light due to the sliding member being moved to the fold position as seen in FIG. 5G. This indicates that the folding of the carrier 24B is complete and the carrier is ready to be transported. The pushing pin member 74 moves along a slot opening, FIG. 6A, to spin and rotate the folded carrier forms 24A and 24B.

Figure 4A:
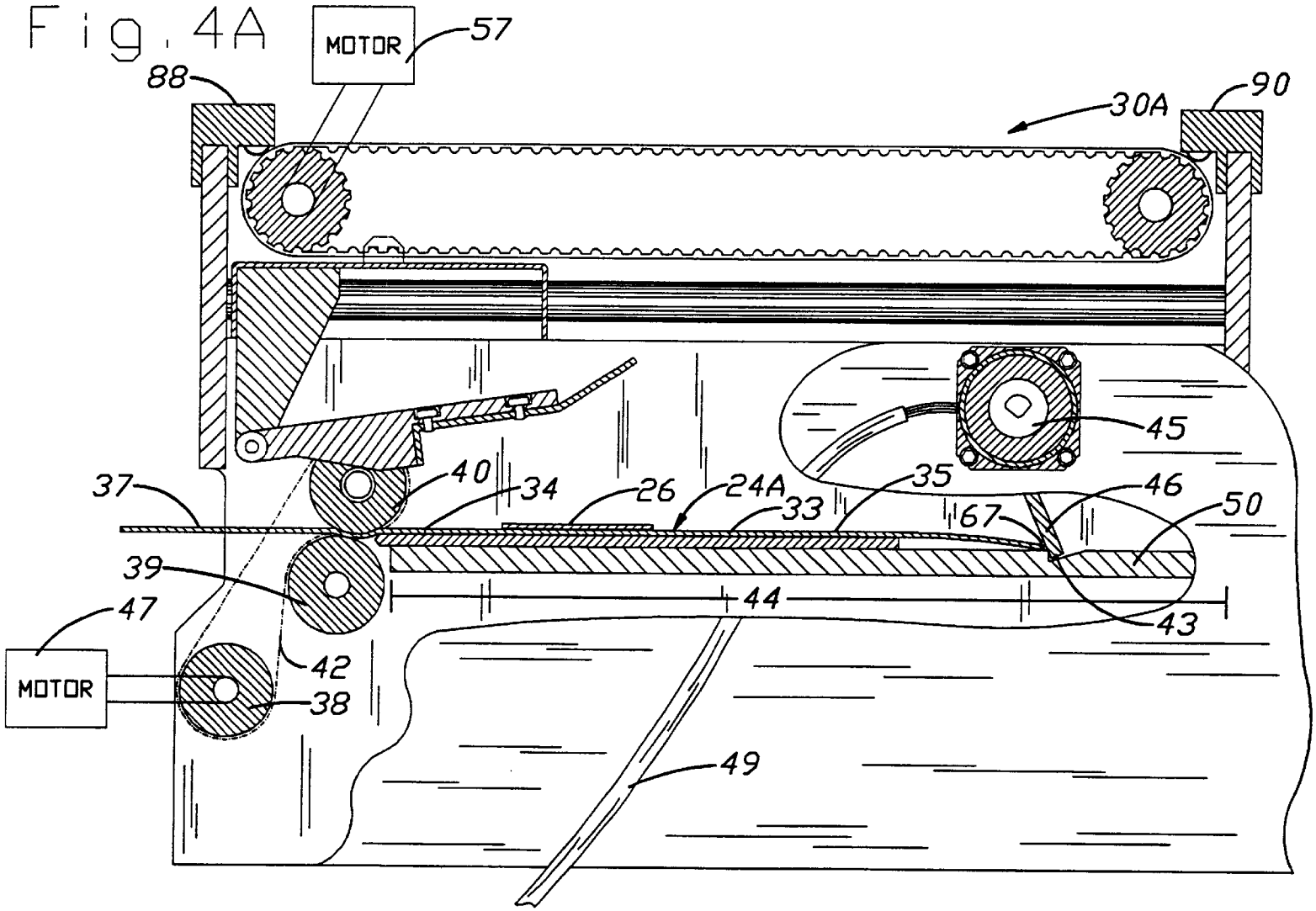
FIG. 4A is a side view of a preferred embodiment of the folding mechanism employed to fold the carriers of FIGS. 2A and 2B in the card package production system of FIG. 1 with the pusher in a home position.
Figure 4B:
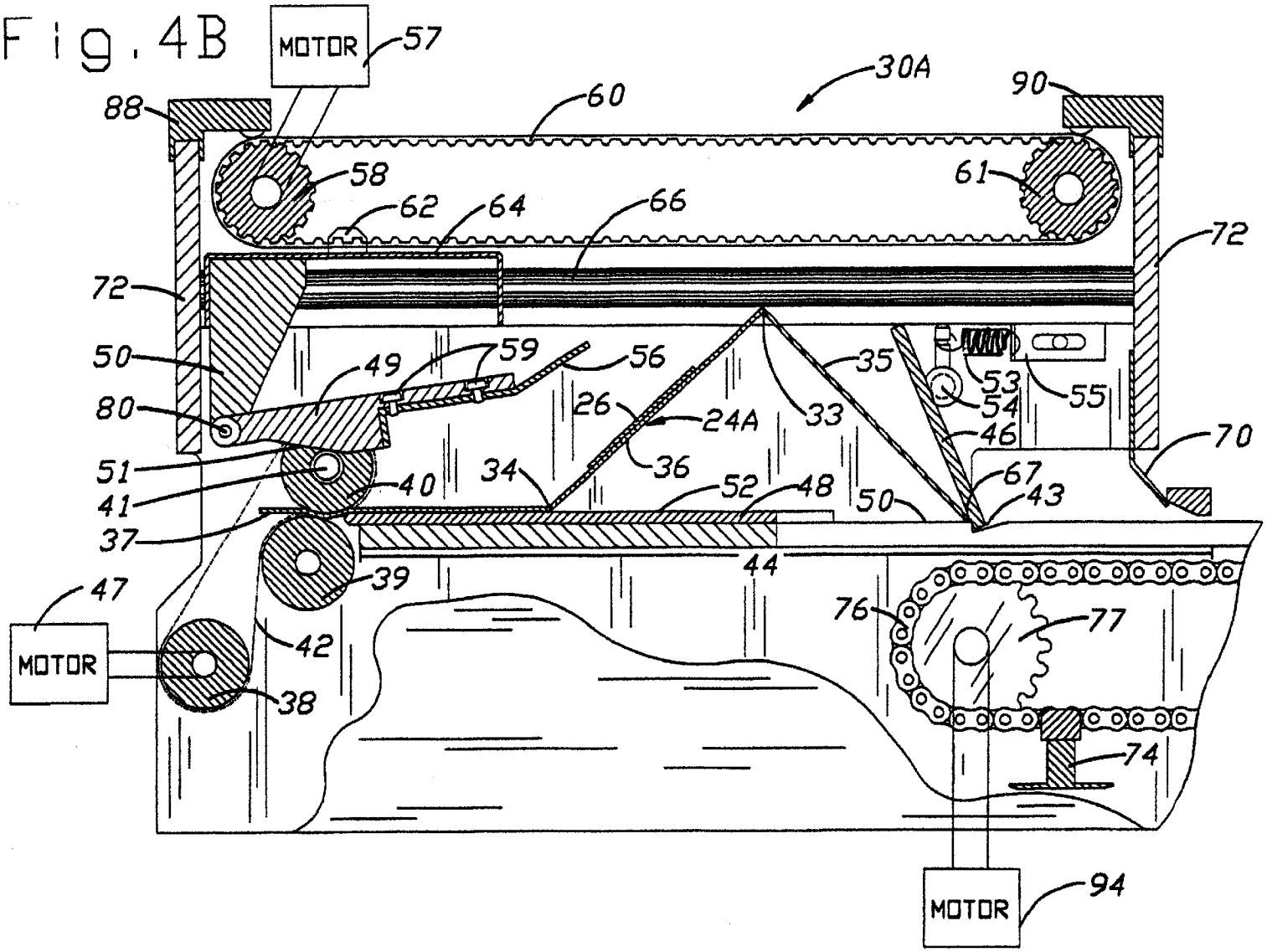
FIG. 4B is a side view of the folding mechanism of FIG. 4A during a later step in the folding sequence in which the carrier form has been pushed upwardly away from the folding path along the leading fold line.
Figure 4C:
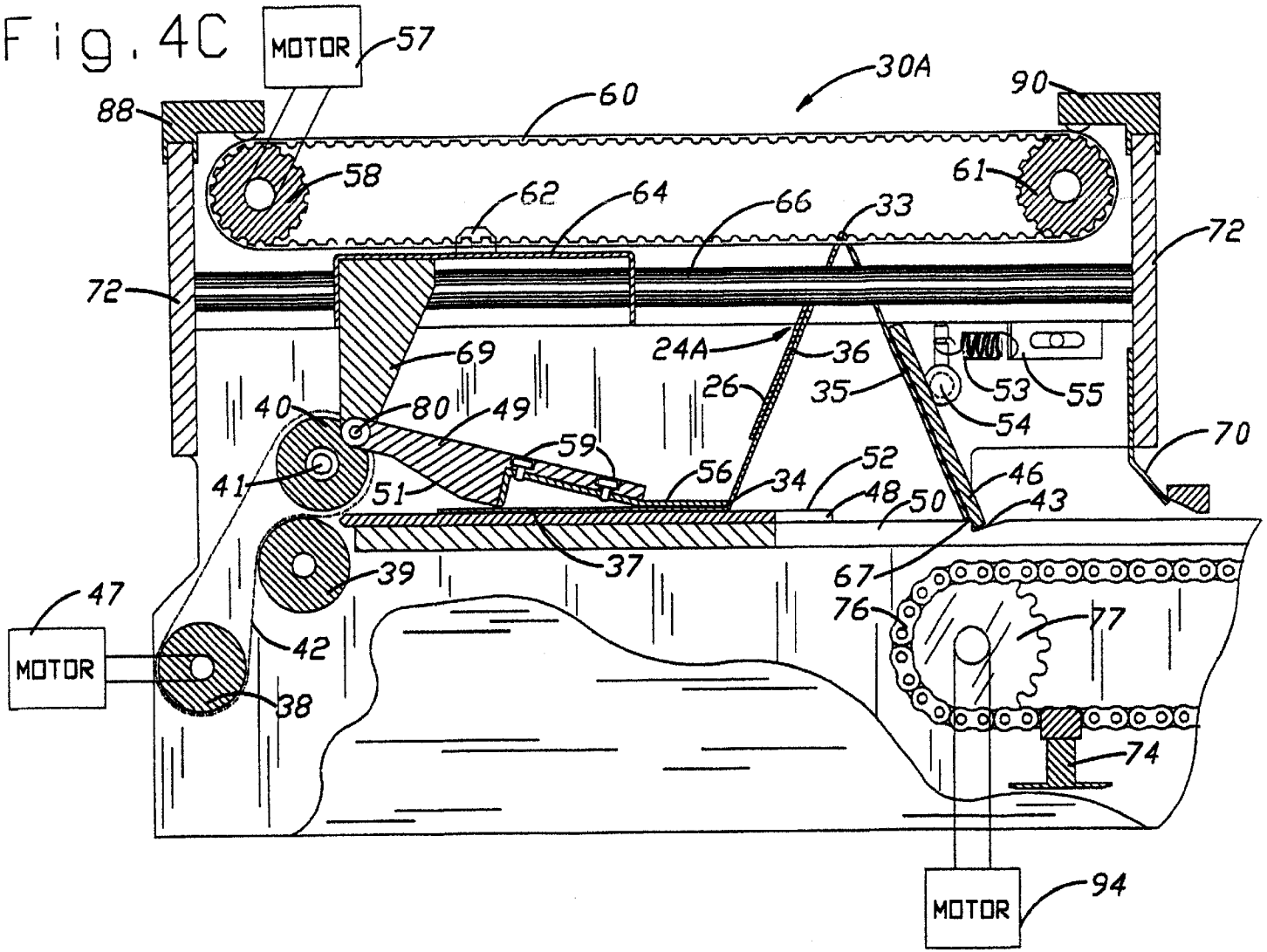
FIG. 4C is a side view of the folding mechanism of FIG. 4B during a still later step in the folding sequence in which the pusher has laterally moved into engagement with the carrier form and has begun pushing it.
Figure 4D:
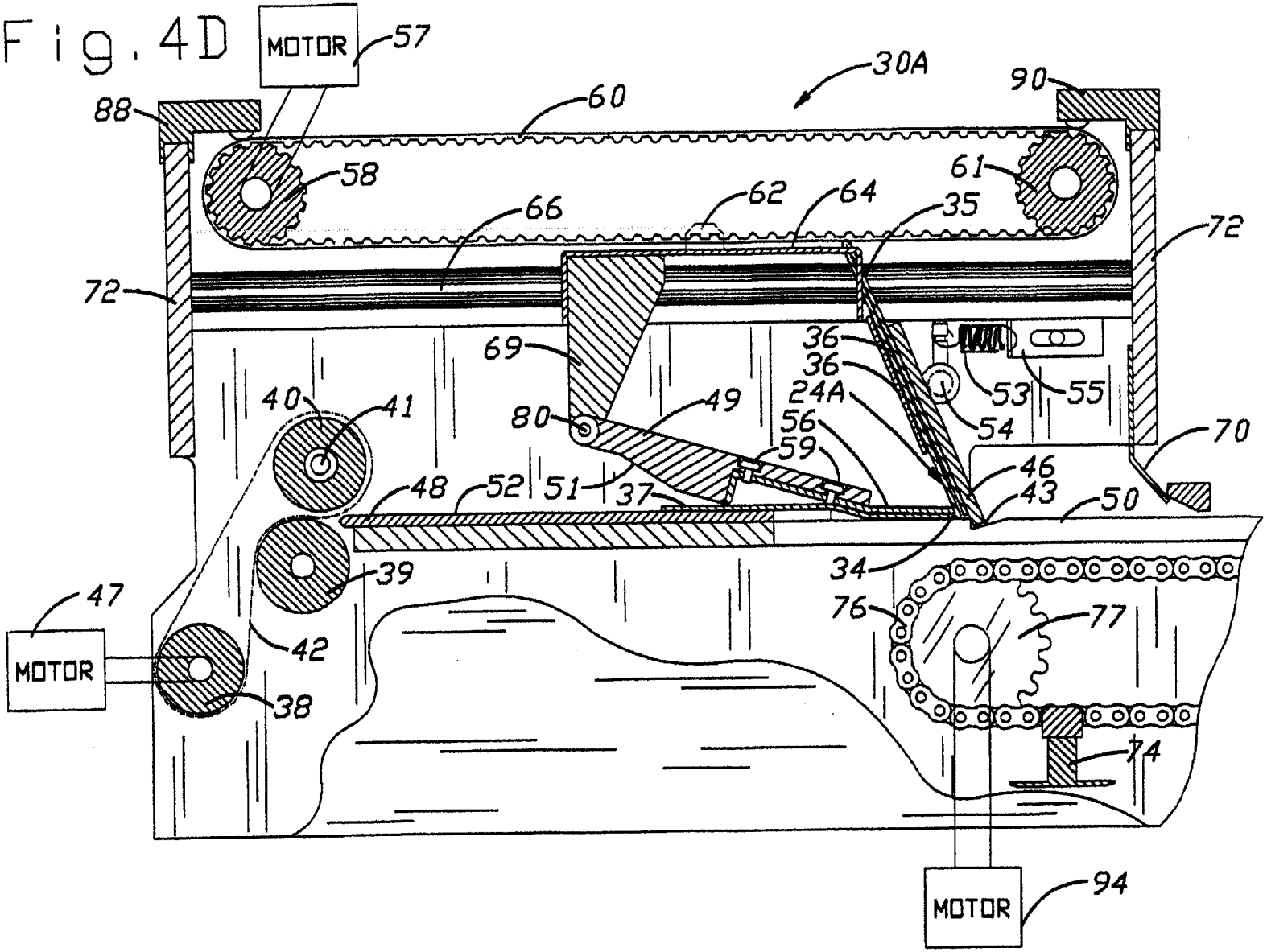
FIG. 4D is another side view of the folding mechanism of FIG. 4C during a later step in the folding sequence in which the pusher has begun pushing the carrier beneath a pivotal stop member.
Figure 4E:
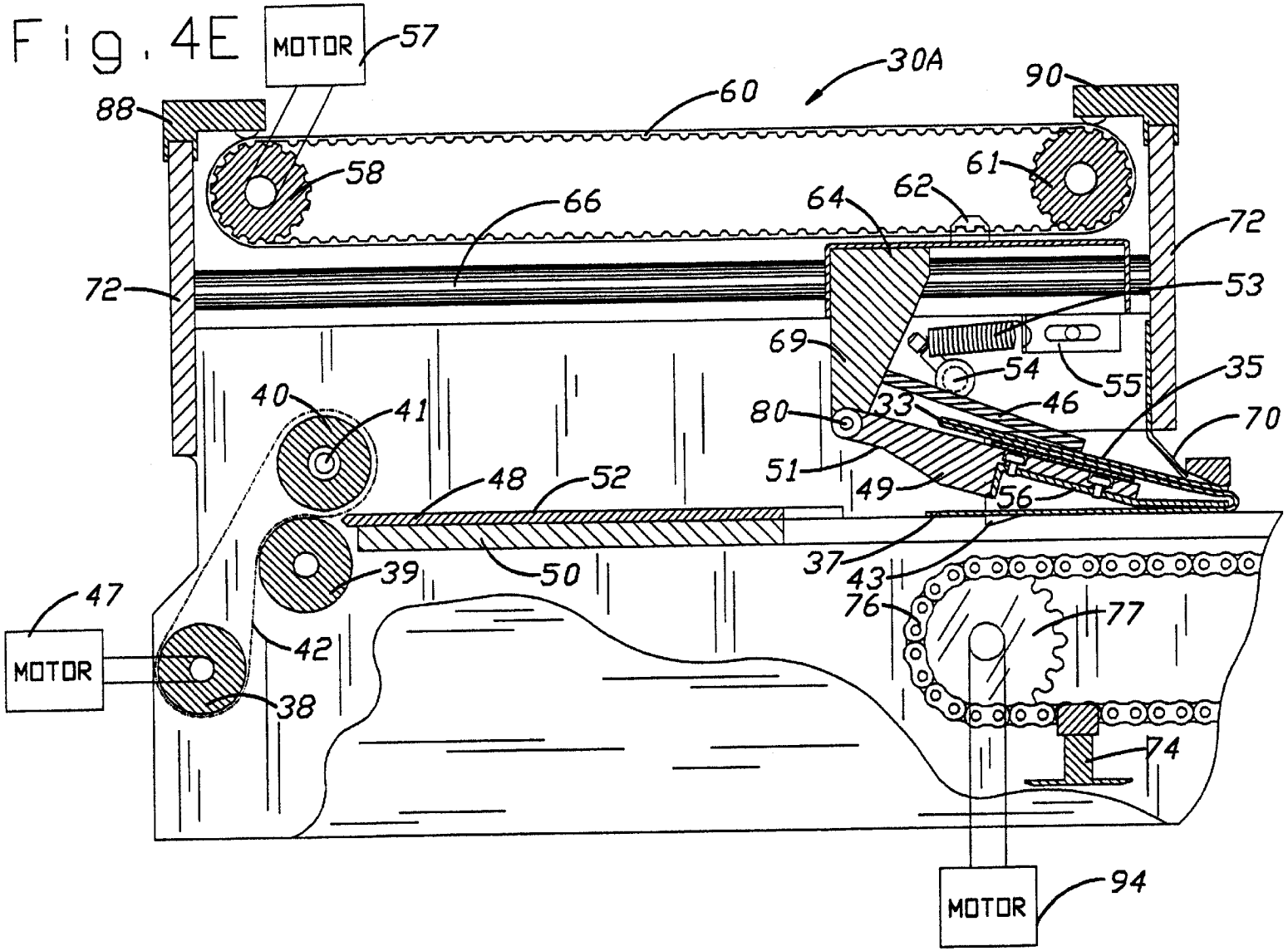
FIG. 4E is another side view of the folding mechanism of FIG. 4D during a still alter step in the folding sequence in which the pusher has pushed the carrier form partially through a folding gap.
Figure 4F:
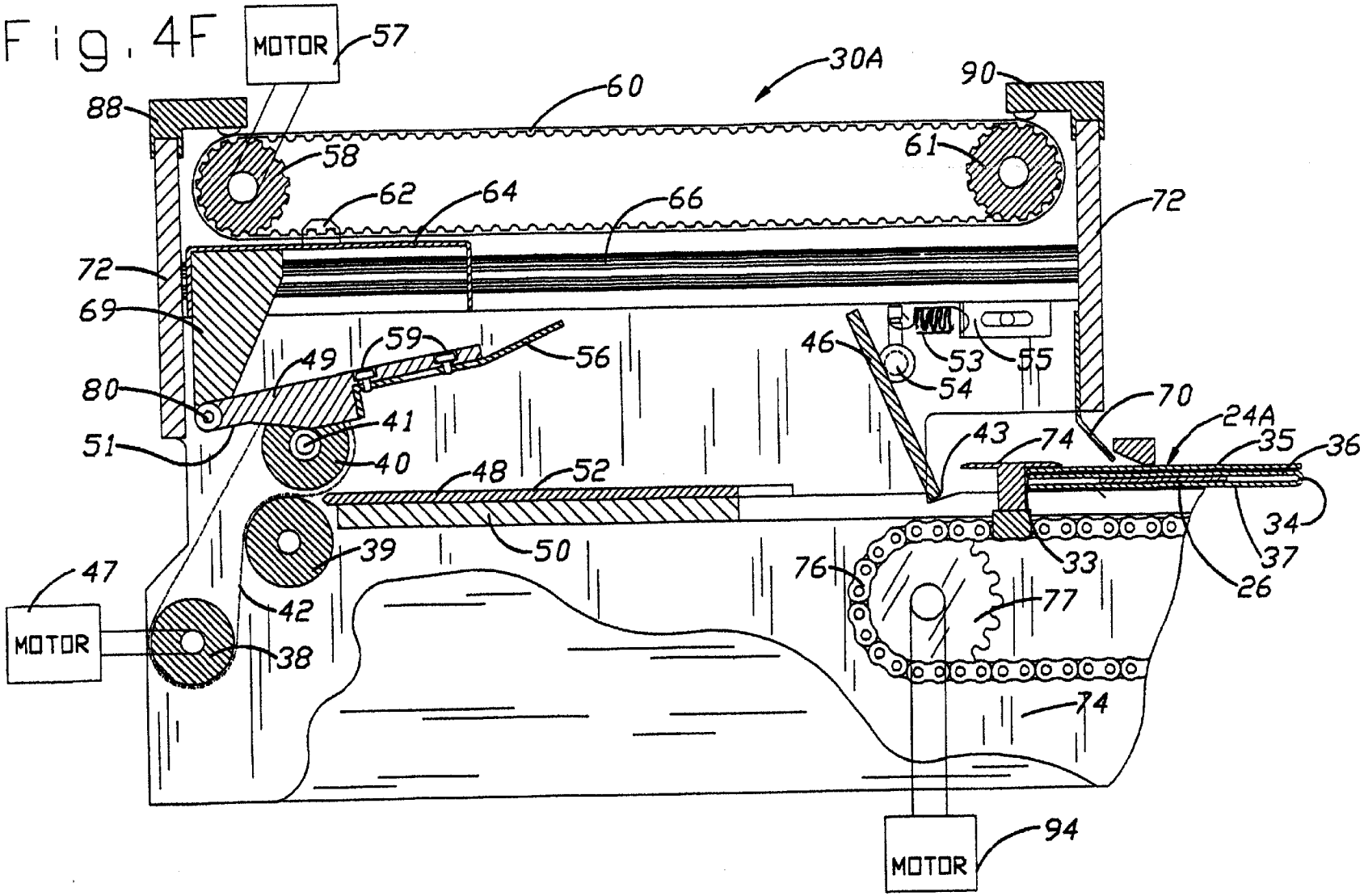
FIG. 4F is still another side view of the folding mechanism of FIG. 4E during a further step in the folding sequence in which the pusher has returned to the home position and a pushing member of the carrier turning mechanism begins pushing the folded carrier through the folding gap.
Figure 6A:
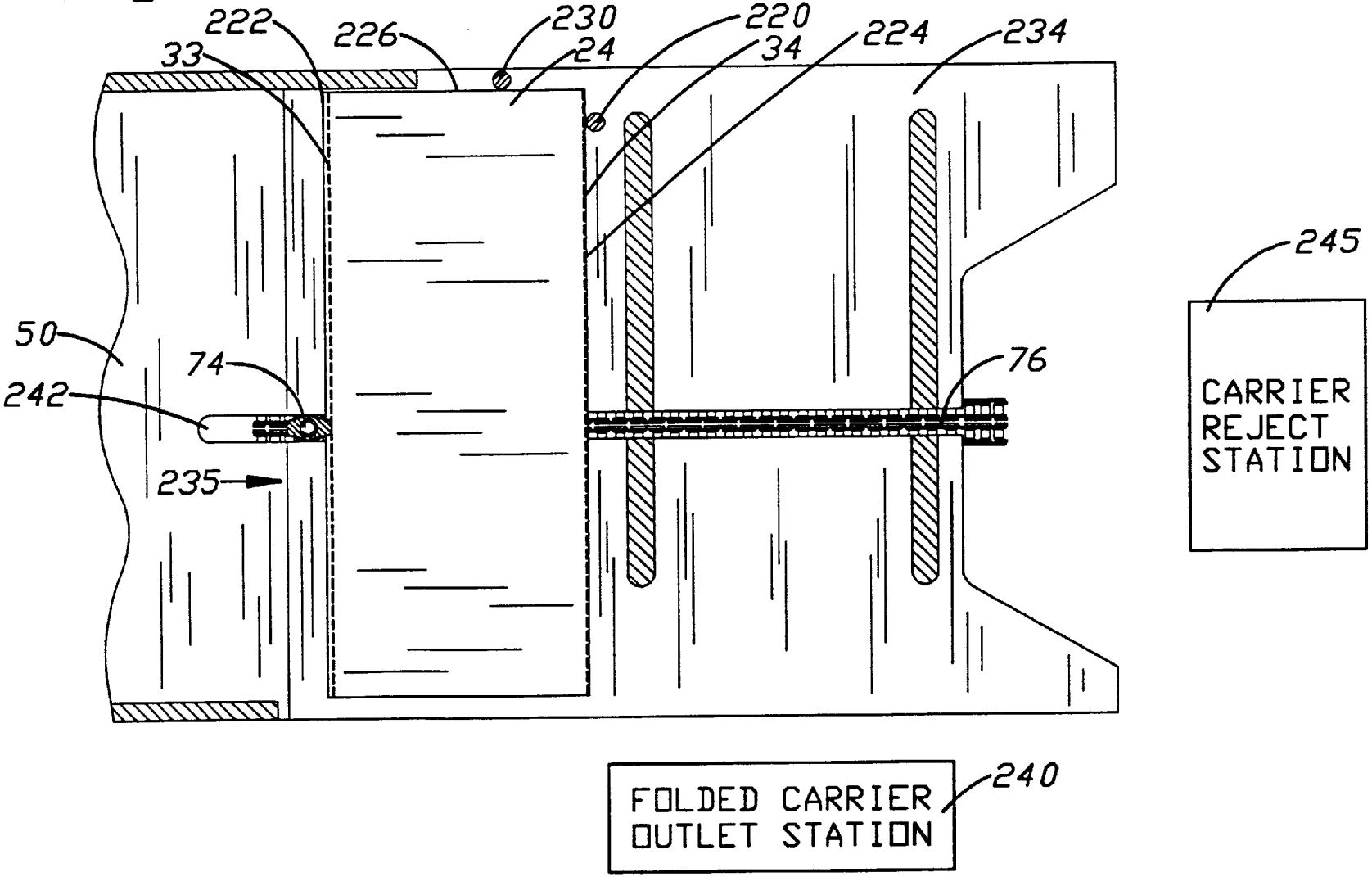
FIG. 6A is a plan view of the preferred embodiment of the carrier form turning apparatus partially shown in FIGS. 4A–4F and 5A–5H at a step in the sequence shown in both FIGS. 4F and 5H.

Referring to FIG. 6A, carrier form 24 is shown having been folded by the card carrier form folding apparatus 30. The folded carrier 24 is turned for transportation to a folded carrier outlet station 240 by means of a transporting pushing pin member 74 interconnected with a circulating chain member 76. As seen in FIGS. 4F and 5H, the chain 76 is interconnected to a sprocket gear 77 driven by motor 94 in response to the fold complete sensor 90 or 190 sensing either sliding member 64 or 170 being in the fold complete position in both embodiments 30A and 30B of the carrier folding apparatus. The chain 76 is connected to another sprocket gear (not shown) to circulate pushing member 74 through the elongate slot opening 242. The motor 94, FIG. 4F, drives chain 76 to move the pushing member 74 through slot opening 242, FIG. 6A, and into contact with an edge 222 of the carrier form. In FIG. 6A, the folded carrier 24 is shown having a preselected orientation with a side edge 226 of the carrier substantially parallel to the elongate slot opening 242. The pushing member 24 transports the carrier in a preselected direction as shown by direction arrow 235 parallel to the planar body of the carrier. As seen in FIG. 6A, the folded carrier 24 has its fold lines 33 and 34 aligned in a direction generally transverse to the preselected direction indicated by arrow 235.

Extending vertically from the folded carrier support surface plate 234 is a pivot pin 220. The pushing member 74 pushes one edge 224 of the carrier form into the pivot pin 220 to pivot edge 224 about pin 220 and to turn the folded carrier 24. Another pivot pin 230 is located adjacent pivot pin 220 to engage another edge 226 of the carrier 24 adjacent the one edge 224. Pushing member 74 engages the back edge 222 of the carrier form 24 opposite edge 224 at a location laterally spaced from the pivot pin 220 at a distance greater than the width dimension along edge 226 of the carrier 24 for movement of the carrier transverse to fold lines 33 and 34. The spacing of the pushing member 74 relative to the pivot pin 220 allows the carrier form to turn and pivot about pin 220 as the carrier is moved by the pushing member.

Figure 6B:
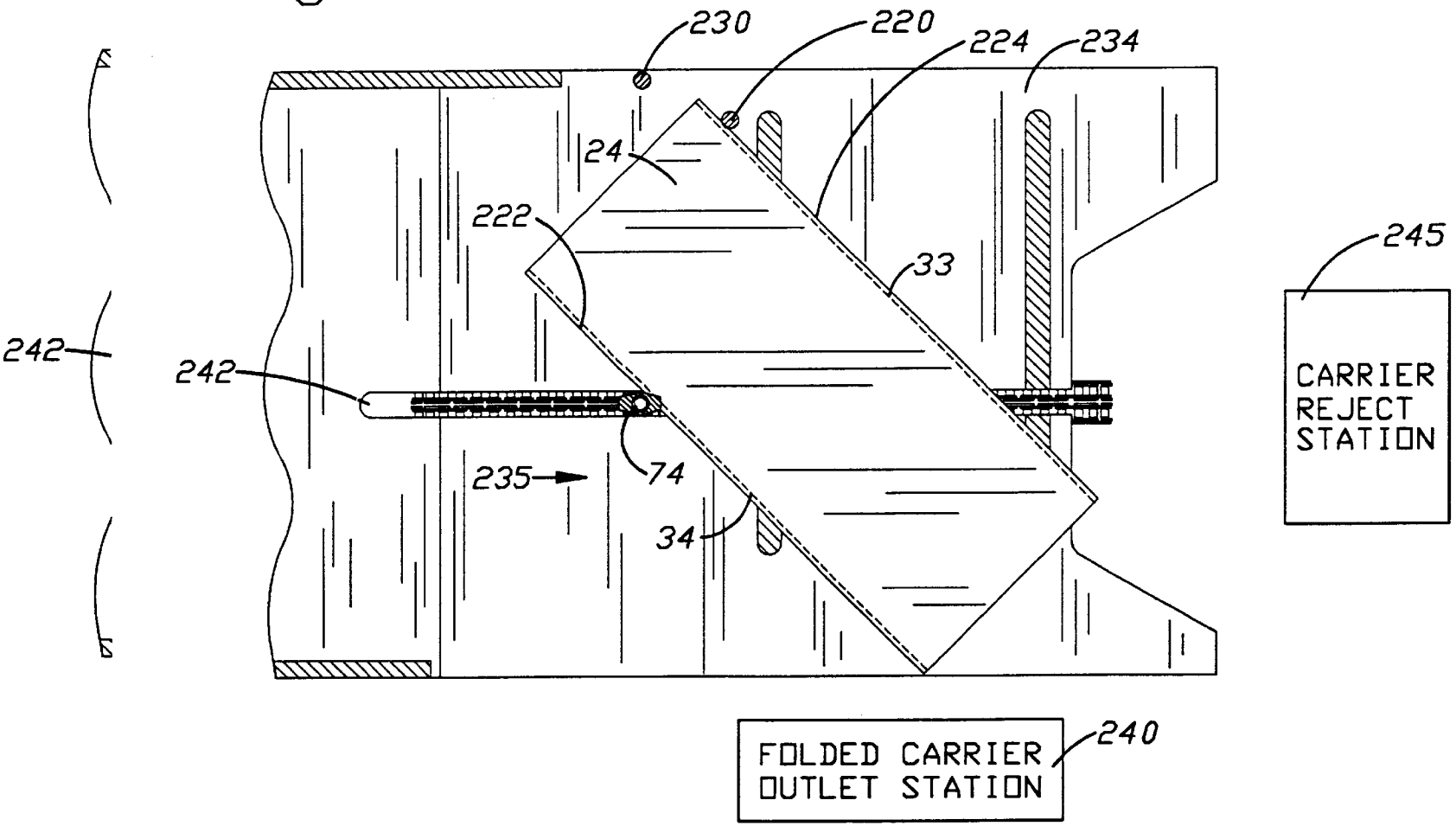
FIG. 6B is a plan view of the preferred embodiment of the carrier form turning apparatus of FIG. 6A during a later step in the sequence in which the carrier has been partially pivoted around a pivot pin.

Referring to FIG. 6B, the pushing member 24 slides along edge 222 opposite edge 224 as the chain 76 moves the pushing member in the preselected direction indicated by arrow 235 to a location opposite the pivot pin 220. As the carrier 24 is transported it is turned counterclockwise about pivot pin 220. The movement of pushing pin 74 turns the folded carrier in the plane of the planar body from the preselected orientation, seen in FIG. 6A, to the orientation shown in FIG. 6C.

Figure 6C:
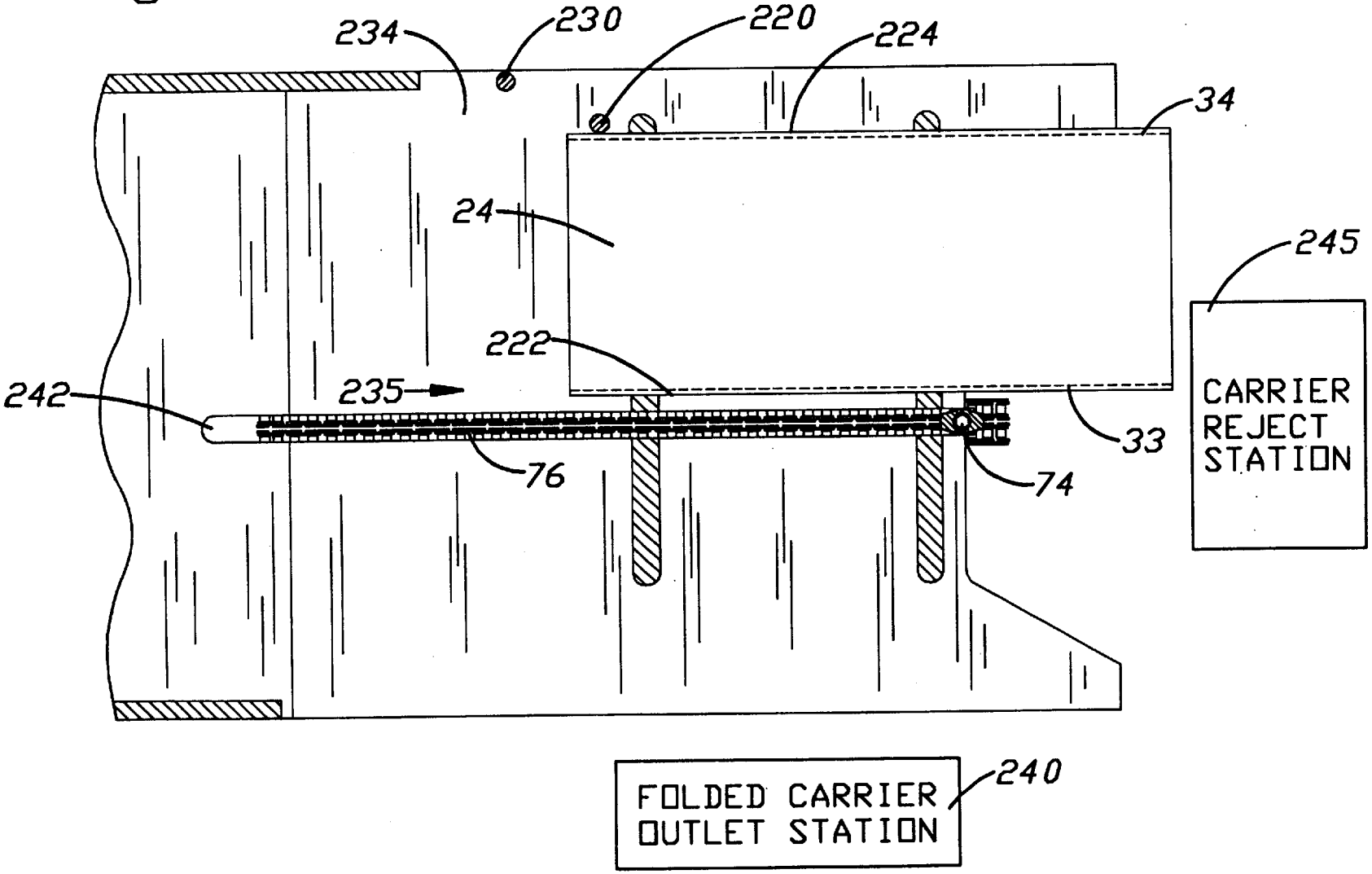
FIG. 6C is a plan view of the turning apparatus of FIG. 6B during a later step in the sequence during which the carrier has been fully turned and is ready for ejection to an envelope stuffer.

Referring to FIG. 6C, the pushing member 74 turns the folded carrier 24 about pivot pin 220 approximately ninety degrees to substantially align the fold lines 33 and 34 with the preselected direction which the carriers are transported as indicated by arrow 235. The pushing member 74 moves the folded carrier form 24 about pivot pin 220 until edge 222 is substantially parallel to the preselected direction 235. The turned and folded carrier 24 is in a position to be transported by a pair of upper claws (not shown) to the folded carrier outlet station 240. The folded carriers are fully turned for ejection to an envelope stuffer at the folded carrier outlet station 240. Carrier packages 22, FIGS. 2A, 3A, having cards 26 inserted into corresponding and matching carrier forms 24 are stacked at the folded carrier outlet station 240 for stuffing into window envelopes. Carriers 24 not containing matching embossed cards 26 are transported to a carrier reject station 245 to separate carriers having incorrect information from the matching carrier forms thereby preventing incorrect carriers from being stuffed into window envelopes and subsequently being mailed. For further details concerning other aspects of the embossed card pack production system, reference should be made to the following applications filed contemporaneously herewith and assigned to the same assignee of the present invention:

U.S. patent applications Ser. No. 08/036,657 of Hill et al. entitled "Automatic Verified Embossed Card Package Production Methods" filed Mar. 24, 1993; U.S. Ser. No. 08/036,159 of Hill et al. entitled "Card Package Production System With Burster and Carrier Verification Apparatus" filed Mar. 24, 1993; U.S. Ser. No. 08/036,664 of Hill et al. entitled "Embossed Card Package System With Modular Inserters For Multiple Forms And Card Verification Apparatus" filed Mar. 24, 1993; and U.S. Ser. No. 08/036,436 of Hill et al. entitled "Card Carrier Forms For Automated Embossed Card Package Production System" filed Mar. 24, 1993, all filed contemporaneously herewith.

While a detailed description of the preferred embodiment of the invention has been given, it should be appreciated that many variations can be made thereto without departing from the scope of the invention as set forth in the appended claims.

What is claimed is:

1. In a card package production system for producing card packages with cards mounted to a bifold carrier form with a body and first and second parallel spaced preweakened fold lines dividing the body into leading end, middle and lagging end sections, the improvement being a card carrier form folding apparatus, comprising:

means for supporting the leading end, middle and lagging end sections of the carrier form;

means for moving the leading end, middle and lagging end sections along the supporting means in a first direction normal to the fold lines;

means for defining a fold gap;

means for guiding the leading end section to move in a second direction transverse to said first direction until the first fold line between the leading end section and the middle section is aligned with the folding gap; and said moving means moving the middle section and the leading end section adjacent the first fold line through the fold gap to fold the leading end section and the middle section toward each other along the first fold line therebetween as they pass through the gap.

2. The card package production system of claim 1 in which the supporting means includes a carrier support member with a support surface for slidable support of carrier forms being moved in the first direction.

3. The card package production system of claim 1 including a stop member for stopping movement of the carrier in the second direction when the first fold line is aligned with the folding gap.

4. The card package production system of claim 3 in which the guiding means includes a stop guide for guiding the carrier form to the stop member, and a middle guide for guiding the carrier form to the stop guide.

5. The card package production system of claim 4 in which the first direction is substantially horizontal, the second direction is substantially vertical, and the middle guide extends in a substantially diagonal direction.

6. The card package production system of claim 3 in which said folding gap defining means includes means for mounting the middle guide and the stop guide with the folding gap therebetween.

7. The card package production system of claim 1 in which said moving means includes means for moving the lagging end section through the gap.

8. The card package production system of claim 7 in which said moving means includes a roller in rolling contact with the carrier form.

9. The card package production system of claim 7 including means for defining a folding path for the carrier to travel on a side of the gap opposite the guiding means, a stopping member in the path to block movement of a folded edge of the carrier at the first fold line between the leading end section and the middle section; and means for moving an edge of the lagging section along the path toward the stopping member and the first fold line between the leading end section and the middle section to buckle and fold together the lagging end section and the middle section of the carrier form along the second fold line.

10. The card package production system of claim 9 in which said moving means includes means for moving the middle section toward the stopping member to tip the carrier form over the stopping member.

11. The card package production system of claim 10 in which said moving means includes means for pushing both an edge of the lagging end section and the upwardly buckled body of the end section.

12. In a card package production system for producing card packages with cards mounted to a bifold carrier form with a planar body having first and second sides and first and second parallel, spaced, preweakened fold lines dividing the body into leading end, middle and lagging end sections, the improvement being a card carrier form folding apparatus, comprising:

means for defining a fold path;

means for folding the leading end section over the first side of the middle section along the first fold line therebetween;

means in the folding path for blocking movement of the folded leading end section and middle section adjacent the first fold line therebetween along the path; and means for moving the lagging end section toward the blocking member to buckle the lagging end section and middle section away from the folding path and fold the lagging end section toward folded engagement with the second side of the middle section opposite the first side of the middle section along the second fold line therebetween.

13. The card package production system of claim 12 in which said moving means includes means for pushing an edge of the lagging end section.

14. The card package production system of claim 13 in which said moving means includes means for pushing the body of the lagging end section at a location spaced from the edge of the lagging end section.

15. The card package production system of claim 14 in which said moving means tips the lagging end section over the movement blocking means onto the middle section.

16. The card package production system of claim 12 in which said moving means includes means for pushing the body of the lagging end section at a location spaced from the edge of the lagging end section.

17. The card package production system of claim 12 in which said moving means tips the lagging end section over the movement blocking means onto the leading end section.

18. The card package production system of claim 12 in which said moving means includes a pushing member, means for mounting the pushing member for translational movement along the folding path to push the carrier form therealong, and means for moving the pushing member for movement lateral relative to the folding path between a pushing position in which the pushing member is engageable with the carrier form on the path and a passing position in which the carrier form is enabled to pass by the pushing member into a pushing position.

19. The card package production system of claim 18 in which said lateral movement mounting means includes means for mounting the pushing member for pivotal movement.

20. The card package production system of claim 18 in which said lateral movement mounting means includes means responsive to said translational movement to actuate the lateral movement mounting means to laterally move the pushing member relative to the folding path.

21. In a card package production system with a top and a bottom for producing card packages with cards mounted to a bifold carrier form with a body having first and second sides and first and second parallel, spaced, preweakened fold lines dividing the body into leading end, middle and lagging end sections, the improvement being a card carrier form folding apparatus, comprising:

means for folding the form about said first and second fold lines with the first side of the leading end section facing in a first direction; and means for flipping the folded carrier form to a position with the second side of the leading end section facing in a second direction opposite to the first direction.

22. The card package production system of claim 21 in which said flipping means includes a stopping member for blocking an edge of the folded form from movement, and means for pivoting the folded form about a folded edge of the folded form at the fold line between the leading end section and the middle section until the folded form flips over the stop member.

23. The card package production system of claim 22 in which said pivoting means includes means for moving an edge of the lagging end section toward the stopping member to fold the lagging end section against the middle section, and means for pushing the lagging end section and middle section over the stopping member and onto the leading end section.

24. The card package production system of claim 21 in which said flipping means includes a pushing member, and means for moving the pushing member laterally relative to movement of the form toward the stop member between a pushing position in which the pushing member is engageable with an edge of the carrier form to push it, and a passing position in which the pushing member is spaced from the edge of the carrier form to enable it to pass to a position to be pushed.

25. The card package production system of claim 24 in which said lateral movement mounting means includes means for mounting the pushing member for pivotal movement.

26. The card package production system of claim 24 in which said lateral movement mounting means includes means responsive to said translational movement to actuate the lateral movement mounting means to laterally move the pushing member relative to the folding path.

* * * * *